US011739449B2

(12) United States Patent
Hanamura et al.

(10) Patent No.: US 11,739,449 B2
(45) Date of Patent: Aug. 29, 2023

(54) THREE-DIMENSIONAL ELASTIC CIRCULAR KNITTED FABRIC

(71) Applicant: Asahi Kasei Advance Corporation, Tokyo (JP)

(72) Inventors: Aoi Hanamura, Tokyo (JP); Hidetoshi Sumi, Tokyo (JP)

(73) Assignee: Asahi Kasei Advance Corporation, Tokyo (JP)

( * ) Notice: Subject to any disclaimer, the term of this patent is extended or adjusted under 35 U.S.C. 154(b) by 0 days.

(21) Appl. No.: 17/780,566

(22) PCT Filed: Nov. 28, 2019

(86) PCT No.: PCT/JP2019/046646

§ 371 (c)(1),
(2) Date: May 27, 2022

(87) PCT Pub. No.: WO2021/106165

PCT Pub. Date: Jun. 3, 2021

(65) Prior Publication Data

US 2022/0411975 A1 Dec. 29, 2022

(51) Int. Cl.

| | |
|---|---|
| ***D04B 1/18*** | (2006.01) |
| ***D04B 1/16*** | (2006.01) |
| ***D04B 1/24*** | (2006.01) |

(52) U.S. Cl.

CPC ..... *D04B 1/18* (2013.01); *D04B 1/16* (2013.01); *D04B 1/24* (2013.01); *D10B 2331/02* (2013.01);

(Continued)

(58) Field of Classification Search

CPC ... D04B 1/14; D04B 1/16; D04B 1/18; D04B 7/16; D04B 9/42; D10B 2401/061; D10B 2403/021

See application file for complete search history.

(56) References Cited

U.S. PATENT DOCUMENTS 3,971,234 A * 7/1976 Taylor ..... D04B 1/126 66/196

4,706,315 A 11/1987 von Ondarza (Continued)

FOREIGN PATENT DOCUMENTS

CN 102943338 A 2/2013
JP S50-96781 U 8/1975

(Continued)

OTHER PUBLICATIONS

International Search Report issued in corresponding International Patent Application No. PCT/JP2019/046646 dated Mar. 3, 2020.

(Continued)

*Primary Examiner* — Danny Worrell

(74) *Attorney, Agent, or Firm* — Morgan, Lewis & Bockius LLP

(57) ABSTRACT

Provided is a three-dimensional elastic circular knitted fabric combining light weight, heat retention, stretchability, and press shrinkage resistance. This three-dimensional elastic circular knitted fabric is obtained by connecting two front/back ground structures with a connecting yarn of only a tuck structure, wherein the three-dimensional elastic circular knitted fabric is characterized in that: the two front/back ground structures is solely constituted by non-elastic fiber; the connecting yarn is solely constituted by elastic fiber; the elastic fiber is interwoven at 2-15 courses/1 repeat; the loop density of the knitted fabric is 40-130 courses/inch, and 35-80 wells/inch; the filling rate is 5.0-25.0%; the thermal retention rate is 20.0% or higher; and the rate of elongation at a constant 22.1-N load is 50-200% in the warp direction and 150-300% in the weft direction.

7 Claims, 2 Drawing Sheets

(52) U.S. Cl.
CPC .... *D10B 2331/04* (2013.01); *D10B 2401/061* (2013.01)

(56) References Cited

U.S. PATENT DOCUMENTS

| | | | | |
|---|---|---|---|---|
| 5,250,351 | A | 10/1993 | Kondou et al. | |
| 5,651,847 | A * | 7/1997 | Loeffler | D04B 1/16 66/196 |
| 6,755,052 | B1 * | 6/2004 | Sytz | D04B 1/18 66/196 |
| 6,776,014 | B1 | 8/2004 | Laycock et al. | |
| 6,779,369 | B2 * | 8/2004 | Shepherd | D04B 1/126 66/196 |
| 7,240,522 | B2 * | 7/2007 | Kondou | D04B 21/18 66/195 |
| 7,611,999 | B2 * | 11/2009 | McMurray | D04B 1/126 66/196 |
| 7,937,973 | B2 * | 5/2011 | Sorensen | A61F 13/04 66/196 |
| 9,689,092 | B2 | 6/2017 | Liao et al. | |
| 11,535,964 | B2 * | 12/2022 | Kashima | D04B 1/18 |
| 2004/0097151 | A1 * | 5/2004 | McMurray | D04B 1/126 442/306 |
| 2004/0168479 | A1 * | 9/2004 | McMurray | D04B 1/16 66/202 |
| 2004/0237599 | A1 | 12/2004 | Kondou et al. | |
| 2005/0241286 | A1 | 11/2005 | Weiser et al. | |
| 2009/0019624 | A1 * | 1/2009 | Birk | D02G 3/04 2/81 |

FOREIGN PATENT DOCUMENTS

| | | | |
|---|---|---|---|
| JP | S56-156882 | U | 11/1981 |
| JP | S61-252360 | A | 11/1986 |
| JP | H05-263340 | A | 10/1993 |
| JP | H07-138850 | A | 5/1995 |
| JP | 2001-164444 | A | 6/2001 |
| JP | 2002-069805 | A | 3/2002 |
| JP | 2004-019059 | A | 1/2004 |
| JP | 2004-052157 | A | 2/2004 |
| JP | 2004-076209 | A | 3/2004 |
| JP | 4229641 | B2 | 2/2009 |
| JP | 2014-231665 | A | 12/2014 |
| JP | 2018-021267 | A | 2/2018 |
| JP | 2019-206772 | A | 12/2019 |
| WO | 03/038173 | A1 | 5/2003 |
| WO | 2016/166993 | A1 | 10/2016 |

OTHER PUBLICATIONS

International Preliminary Report on Patentability and Written Opinion issued in corresponding International Patent Application No. PCT/JP2019/046646 dated Jun. 9, 2022.

* cited by examiner

THREE-DIMENSIONAL ELASTIC CIRCULAR KNITTED FABRIC

FIELD

The present invention relates to a circular knitted fabric having a three-dimensional structure. The invention relates more specifically to a circular knitted fabric with a three-dimensional structure having thickness and a heat-insulating property due to the three-dimensional structure, while also being lightweight, stretchable and resistant to pressing shrinkage.

BACKGROUND

Many circular knitted fabrics have been designed to have satisfactory stretchability provided by a loop structure and to exhibit a heat-insulating property as a result of a bulky structure, by means of improved yarns and knitted structures discovered through processes of trial and error with the goal of achieving even greater enhanced functionality. PTL 1, for example, proposes a knitted fabric constructed with two ground weaves on the front and back bonded only by a tuck structure formed by polyurethane elastic fibers, wherein elastic fibers are added to either or both the front and back to provide a prescribed elongation to the warp and weft so that the knitted fabric has favorable shape retention and ability to follow movement, as well as an excellent feel when worn. With the knitted fabric described in PTL 1, however, the elastic fibers are mixed not only with the tuck portion but also with the front and back fabric ground weave portions, and therefore the yarn weight mixing ratio of the elastic fibers is increased and shrinkage or dimensional change tends to occur by hot pressing when the product is worked, or clothing products produced using the knitted fabric tend to be heavier, creating unpleasantness for the wearer.

PTL 2 proposes a knitted fabric with the same knitted fabric form as PTL 1, but provided with thermal insulating spaces inside the knitted fabric by using spun yarn comprising hygroscopic fibers in the back fabric and multifilaments made of hollow hydrophobic fibers for the connecting yarn, whereby it exhibits high heat-insulating properties and moisture absorption and desorption properties. However, the knitted fabric described in PTL 2 lacks stretchability because it does not employ elastic fibers.

CITATION LIST

Patent Literature

[PTL 1] Japanese Patent Publication No. 4229641
[PTL 2] Japanese Unexamined Patent Publication No. 2018-21267

SUMMARY

Technical Problem

In light of these problems of conventional knitted fabrics, the problem to be solved by the invention is to provide a three-dimensional elastic circular knitted fabric having light weight properties, heat-insulating properties, stretchability and resistance to press shrinkage that have not been simultaneously achievable in the prior art.

Solution to Problem

As a result of much ardent research with the goal of solving the aforementioned problems, the present inventors have completed this invention upon finding, unexpectedly, that adjusting the texture of polyurethane elastic fibers and the mixed knitting ratio and employing a special dyeing step makes it possible to obtain a three-dimensional elastic circular knitted fabric having a three-dimensional structure and a light weight with heat-insulating properties, and exhibiting stretchability and hot press shrinkage resistance.

Specifically, the present invention is as follows.

[1] A three-dimensional elastic circular knitted fabric in which two ground weaves on the front and back are bonded by connecting yarn with only a tuck structure, wherein the two ground weaves on the front and back consist entirely of non-elastic fibers, the connecting yarn consists entirely of elastic fibers, the elastic fibers are knitted in a mixture of 2 to 15 course/repeat, the loop density of the knitted fabric is 40 to 130 course/inch and 35 to 80 wale/inch, the filling rate is 5.0 to 25.0%, the heat insulation rate is 20.0% or greater, and the elongation percentage at a constant load of 22.1 N is 50 to 200% in the warp direction and 150 to 300% in the weft direction.

[2] The three-dimensional elastic circular knitted fabric according to [1] above, wherein the non-elastic fiber is polyester or nylon synthetic fiber single yarn or composite yarn comprising either or both polyester or nylon yarn.

[3] The three-dimensional elastic circular knitted fabric according to [1] or [2] above, wherein the yarn d weight mixing ratio of elastic fibers with respect to the entire knitted fabric is 5 to 15%.

[4] The three-dimensional elastic circular knitted fabric according to any one of [1] to [3] above, wherein the press shrinkage rate in the warp direction and weft direction is in the range of 0 to −2% according to JIS L 1096 H-2.

[5] Outer wear comprising a three-dimensional elastic circular knitted fabric according to any one of [1] to [4] above.

[6] Inner wear comprising a three-dimensional elastic circular knitted fabric according to any one of [1] to [4] above.

[7] Sport wear comprising a three-dimensional elastic circular knitted fabric according to any one of [1] to [4] above.

Advantageous Effects of Invention

The three-dimensional elastic circular knitted fabric of the invention has a three-dimensional structure and light weight even while exhibiting a heat-insulating property, as well as both stretchability and hot press shrinkage resistance, and it can therefore be suitably utilized for outer wear, inner wear and sport wear.

DESCRIPTION OF EMBODIMENTS

Figure 1:
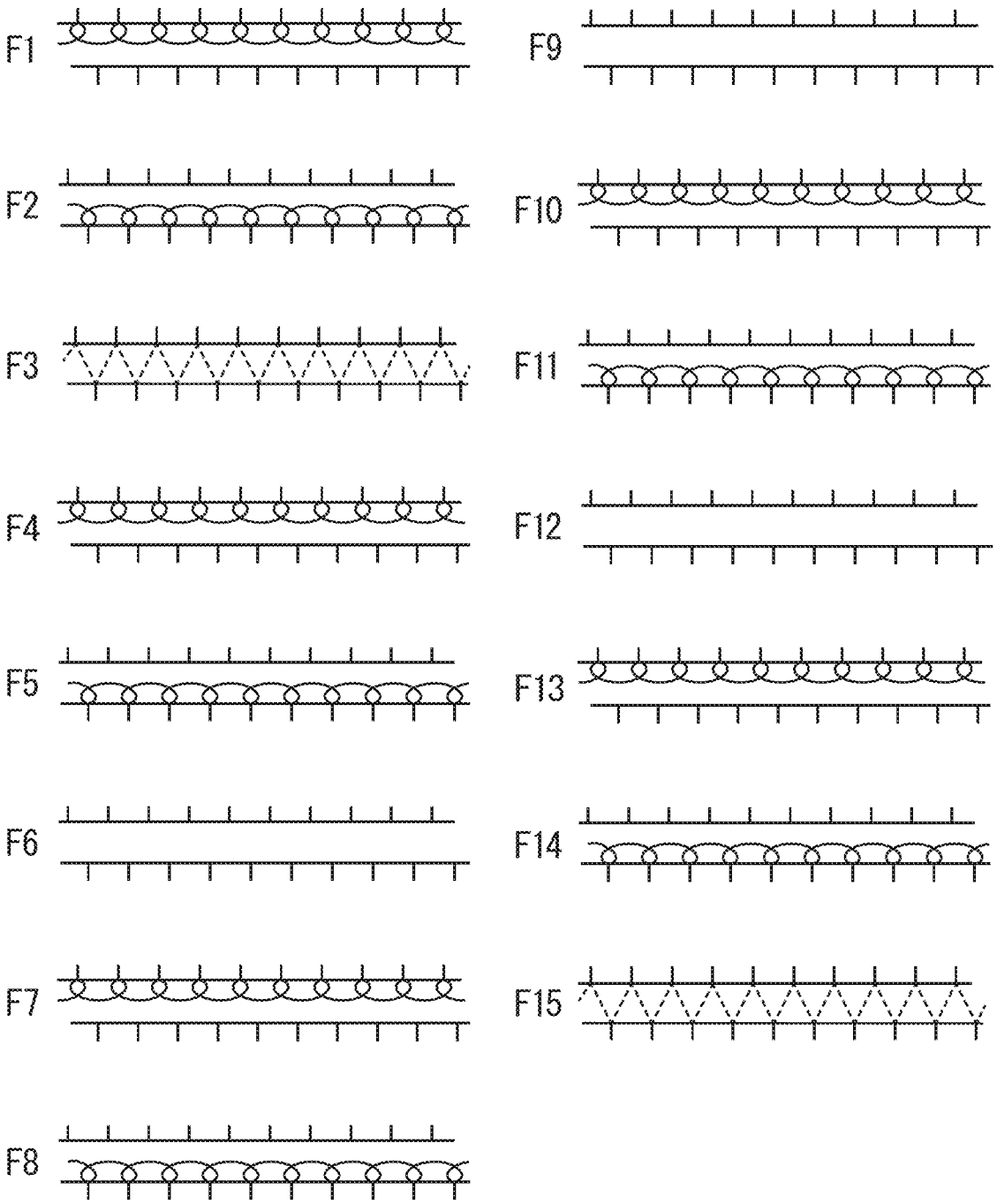
FIG. 1 is a knitting diagram for the elastic circular knitted fabric of Example 1.

The invention will now be explained in detail using an embodiment.

The three-dimensional elastic circular knitted fabric of the embodiment is a three-dimensional elastic circular knitted fabric in which two ground weaves on the front and back are bonded by connecting yarn with only a tuck structure, wherein the two ground weaves on the front and back consist entirely of non-elastic fibers, the connecting yarn consists entirely of elastic fibers, the elastic fibers are knitted in a mixture of 2 to 15 course/repeat, the loop density of the knitted fabric is 40 to 130 course/inch and 35 to 80 wale/inch, the filling rate is 5.0 to 25.0%, the heat insulation rate is 20.0% or greater, and the elongation percentage at a constant load of 22.1 N is 50 to 200% in the warp direction and 150 to 300% in the weft direction.

The elastic yarn in the three-dimensional elastic circular knitted fabric of the embodiment is used only for the connecting yarn and not for the two ground weaves on the front and back. It is thus possible to lower the yarn weight mixing ratio of the elastic fiber with respect to the entire knitted fabric to a relatively low value of preferably 5 to 15%, and to reduce shrinkage of the knitted fabric while providing it with suitable stretchability. Since elastic fibers more easily expand and contract than non-elastic fibers, a yarn weight mixing ratio of greater than 15% is not preferred because it results in excessive aggregation of the knitted fabric and increases the fill factor, making clothing articles formed from it heavier and causing more drastic dimensional change due to shrinkage under hot pressing when the product is processed. A yarn weight mixing ratio of less than 5% is also not preferred because the stretchability will be reduced. The yarn weight mixing ratio of the elastic fibers with respect to the entire knitted fabric is preferably 7 to 12%.

In the three-dimensional elastic circular knitted fabric of the embodiment, the elastic fibers used only in the connecting yarn are knitted in a mixture of 2 to 15 course/repeat. A "repeat" is the number of times an elastic fiber is repeatedly knitted into a fabric, and for example, if the 1st course is counted as the course where the elastic fiber is initially knitted, 5 course/repeat is counted from that point as 5 courses of elastic fibers knitted. Such knitting can create gaps between the front fabric and back fabric where connecting yarn is not present. Such gaps can exhibit a thermal insulating layer effect to retain heat released from the skin of the body during wear. If the elastic fiber is knitted at less than 5 course/repeat, the fibers which have thermal conductivity of several dozen times that of air will be more abundantly present in the intermediate layers of the knitted fabric between the front fabric and back fabric, which is undesirable as heat released from body skin will be further released from the back fabric to the front fabric and out to the outer environment. If it is knitted at an interval of greater than 15 course/repeat, on the other hand, the mixing ratio of elastic fibers will be too low, making it impossible to maintain the three-dimensional structure of the knitted fabric and resulting in collapse of the thermal insulation layer and loss of stretchability. The elastic fibers are preferably knitted in a mixture of 3 to 8 course/repeat.

The three-dimensional elastic circular knitted fabric of the embodiment can be produced without pre-setting during the dyeing step, by applying a formulation with lowered fabric speed in the dyeing bath. Without pre-setting, a higher loop density can be obtained for the knitted fabric and increase in gaps between loops can be inhibited, preventing loss of captured heat to the outside to increase the heat-insulating property. Lowering the fabric speed during dyeing will also help prevent elongation due to tensile force in the lengthwise direction of the knitted fabric, and can help lower the loop density. Jet dyeing machines commonly used for knitted fabric dyeing in recent years carry out dyeing while agitating by spray of a staining solution from a jet nozzle mounted on a pump in the apparatus, and the fabric speed can be reduced by adjusting the pressure of the jet nozzle. Specifically, the fabric speed is preferably no greater than 90% of 350 m/min (the maximum fabric speed), although this varies depending on the machine. This formulation can be applied if the elastic fibers are used only as the connecting yarn in the knitted fabric and the yarn weight mixing ratio is 5 to 15%. This is because if the elastic fibers are also knitted in the front fabric or back fabric at the non-connecting sections and the yarn weight mixing ratio is above the aforementioned range, the knitted fabric will undergo more drastic shrinkage and it will not be possible to repair shape stability or surface wrinkles without subjecting it to preheat setting. Since the three-dimensional elastic circular knitted fabric of the embodiment has a lower elastic fiber mixing ratio than the prior art and is not in a ground weave, it can exhibit stretchability and press shrinkage resistance by pushing in and tensile force reduction treatment during processing.

The three-dimensional elastic circular knitted fabric of the embodiment has a post-dyeing loop density of 40 to 130 course/inch (2.54 cm), and 35 to 80 wale/inch. The loop density is preferably not lower than this range from the viewpoint of the heat-insulating property, since the surface will be coarse and large gaps will be present through which heat that has accumulated in the knitted fabric can be released to the outer environment. It is also undesirable because of adverse effects on the stretchability since the ability of the knitted fabric to extend by elongation is reduced with fewer loops. The post-dyeing loop density is preferably 44 to 70 course/inch (2.54 cm) and 40 to 60 wale/inch.

If the loop density of the three-dimensional elastic circular knitted fabric of the embodiment is within this range, then it will be possible to obtain a fill factor of 5.0 to 25.0%, a heat insulation rate of 20.0% or greater and an elongation percentage at a constant load of 22.1 N of 50% to 200% in the warp direction and 150 to 300% in the weft direction. The term "filling rate" in reference to the knitted fabric is an index of how many fibers are present per knitted fabric volume. From the viewpoint of lightweight property and heat-insulating property, the filling rate of the three-dimensional elastic circular knitted fabric of the embodiment is preferably in the range of 5.0 to 25.0%. If the filling rate exceeds 25.0% the fibers will be too dense resulting in a heavy knitted fabric and thus a heavier article of clothing, while heat will also be transmitted from the back side to the front side, thereby undesirably lowering the heat-insulating property. If the filling rate is less than 5.0%, on the other hand, the density of the knitted fabric will be too low so that it will lack heat-retaining sections, or stated differently, excessive coarseness is undesirable as it will render the knitted fabric more permeable to wind and will lower the heat-insulating property. The filling rate is more preferably in the range of 7.0 to 20.0%.

If this filling rate range is satisfied then the basis weight and thickness are not particularly restricted, although preferably the basis weight is 250 g/m$^2$ or lower and the thickness is 0.6 mm or greater in order to satisfactorily exhibit light weight and thickness as the intended performance of the embodiment. More preferably, the basis weight is 160 to 220 g/m$^2$ and the thickness is 0.7 to 2.0 mm.

In the three-dimensional elastic circular knitted fabric of the embodiment, the heat insulation rate is 20.0% or greater as measured by the dry contact method using a KES-F7 THERMO LABO II (Kato Tech Corp.). If the heat insulation rate of the knitted fabric is lower than 20.0% the cold protection performance of clothing articles using the fabric will be lower and the wearer may experience discomfort. In order to ensure that the heat insulation rate of the knitted fabric is 20.0% or higher, it is essential for dyeing to be carried out at a speed of no greater than 90% of the maximum fabric speed (350 m/min), without presetting during the dyeing step. Using this method will increase the loop density of the knitted fabric and reduce the volume of gaps in the knitted fabric between loops to lower heat dissipation, thereby improving the heat-insulating property. The heat insulation rate is preferably 22.0% to 40%.

The elongation percentage at a constant load of 22.1 N (2.25 kgf) in the three-dimensional elastic circular knitted fabric of the embodiment must be 50 to 200% in the warp direction and 150 to 300% in the weft direction. The elongation percentage at a constant load is an index for evaluating the stretchability of a knitted fabric for clothing. An elongation percentage of less than 50% is undesirable as the stretchability of the knitted fabric will be poor and the knitted fabric will be pulled by joints during movement, lowering the range of motion. An elongation percentage of greater than 200% in the warp direction or 300% in the weft direction, on the other hand, is also undesirable as the knitted fabric will extend too much resulting in loss of firmness and elasticity, and the silhouette of the sewn product will tend to disappear resulting in impairment of the tailored appearance. In order to ensure that the elongation percentage of the knitted fabric is within this range, it is essential for dyeing to be carried out at a speed of no greater than 90% of the maximum fabric speed (350 m/min), without presetting during the dyeing step. This will increase the loop density of the knitted fabric and the extendibility, thereby helping to improve the stretchability. The elongation percentage at a constant load is preferably 70 to 120% in the warp direction and 200 to 250% in the weft direction.

The composition and production method for the elastic fibers to be used in the connecting yarn are not particularly restricted, and the fibers may be polyurethane or polyester elastic yarns such as polyurethane elastic yarns obtained by dry spinning or melt spinning, for example, with no particular restrictions on the polymer or spinning method. The elastic yarn preferably has a breaking elongation of approximately 400% to 1000% and excellent stretchability, and preferably does not lose stretchability in the normal treatment temperature range of near 170 to 140° C. in the final-setting step during dyeing. The elastic yarn can also be provided with functionality such as high-heat setting, antibacterial properties, moisture absorption and water absorption by addition of special polymers or powders. The size of the elastic yarn is not particularly restricted but is preferably about 30 to 110 dtex and more preferably about 30 to 80 dtex from the viewpoint of the light weight property.

The non-elastic fibers composing the two ground weaves on the front and back are preferably made of polyester or nylon synthetic fiber single yarns or composite yarns comprising either or both polyester or nylon yarns. The fiber form is not particularly restricted and may be either spun yarn or filament yarn. Polyester fibers are preferably made of a polyester comprising terephthalic acid as the main acid component, and an alkylene glycol of 2 to 6 carbon atoms, i.e. one or more glycols selected from the group consisting of ethylene glycol, trimethylene glycol, tetramethylene glycol, pentamethylene glycol and hexamethylene glycol as the main glycol component. A preferred component is polyethylene terephthalate composed mainly of ethylene glycol or polytrimethylene terephthalate composed mainly of trimethylene glycol. A small amount of a copolymerizing component (normally 30 mol % or lower) may also be added if necessary, examples of such components including aromatic, aliphatic and alicyclic bifunctional carboxylic acids such as isophthalic acid, 5-sodiumsulfoisophthalic acid, diphenyldicarboxylic acid, diphenoxyethanedicarboxylic acid, β-hydroxyethoxybenzoic acid, p-oxybenzoic acid, adipic acid and 1,4-cyclohexanedicarboxylic sebacate. Examples of diol compounds other than these glycols include aliphatic, alicyclic and aromatic diol compounds such as cyclohexane-1,4-dimethanol, neopentyl glycol, bisphenol A and bisphenol S, and polyoxyalkylene glycols.

A polyester may be one synthesized by any method. A polyester can be produced, for example, by direct esterification reaction of terephthalic acid and ethylene glycol, or transesterification reaction of terephthalic acid and ethylene glycol such as dimethyl terephthalate, or transesterification reaction of a lower alkyl ester of terephthalic acid such as dimethyl terephthalate with ethylene glycol, or a two-stage reaction with a first-stage in which terephthalic acid and ethylene oxide are reacted to obtain a glycol ester of terephthalic acid and/or a low polymer thereof, and a second-stage in which the first-stage reaction product is heated under reduced pressure and subjected to polycondensation reaction to the desired degree of polymerization.

If necessary, the polyester fibers may also contain one or more inorganic particles such as matte agents (titanium oxide compounds), ultraviolet absorbers, micropore-forming agents (organic sulfonic acid metal salts), anti-staining agents, heat stabilizers, flame retardants (antimony trioxide), fluorescent whitening agents, color pigments, antistatic agents (sulfonic acid metal salts), moisture absorbents (polyoxyalkylene glycols) or antimicrobial agents, in an amount of 0.1 wt % or greater.

Nylon fibers may be fibers of nylon 6, nylon 66 or nylon 610, for example.

There are no particular restrictions on fibers other than polyester or nylon in the composite yarn, and they may be spun yarn or filament yarn fibers. Specific examples of spun yarn include natural fibers such as cotton, wool and hemp, regenerated cellulose fibers such as rayon, acetate and cupra, and synthetic fibers such as acrylic, polypropylene and vinyl chloride-based fibers, either alone or spun together.

The three-dimensional elastic circular knitted fabric of the embodiment must have a press shrinkage rate in the range of 0% to −2% in both the warp direction and weft direction, according to JIS L 1096 H-2. If the shrinkage factor exceeds −2%, (an absolute value exceeding 2), it can result in sizing problems after processing of the product through pressing steps, or can result in dimensional contraction when the knitted fabric product is exposed to water or heat during maintenance such as washing or ironing. For this embodiment, the press shrinkage rate will generally not exceed 0% (it will not be positive). For the dimensional change rate after washing to be within −2% (an absolute value of ≤2) it is important for pre-setting not to be carried out during the dyeing step. The pre-setting referred to here is a step of heating of the fabric while stretching it in both the warp and weft directions on a machine known as a setter in order to set the fabric width and length dimensions and remove wrinkles. Shrinkage of the fabric can be inhibited by not carrying out pre-setting. The press shrinkage rate is preferably in the range of 0% to −1.5% in both the warp direction and weft direction.

EXAMPLES

The present invention will now be explained in detail using Examples and Comparative Examples. However, it is to be understood that the invention is not limited to these examples.

The methods for measuring the physical properties used in the Examples and Comparative Examples will be explained first.

[Thickness (mm)]

Using a thickness meter by Peacock Co., the knitted fabric was measured at five randomly selected sections of φ3.0 cm, and the average value was determined and recorded as the thickness (mm) of the knitted fabric.

[Filling Rate (%)]

The basis weight, thickness and yarn weight mixing ratio were applied in the following formula:

Fill factor (%)=Basis weight (or weight per square meter) (g/m$^2$)/thickness (mm)/(mean specific gravity×10)

for the knitted fabric that had been humidified for 1 day at 20° C.×65% RH. The mean specific gravity is obtained from the value of the sum of specific gravities of the fiber types×the mixing ratio according to fiber type in the knitted fabric (%), the specific gravity of polyester fibers being 1.38, the specific gravity of polyurethane fibers being 1.00 and the specific gravity of cupra fibers being 1.50.

[Basis Weight (Or Weight Per Square Meter) (g/m$^2$)]

A 10 cm×10 cm sample was cut out from the knitted fabric that had been humidified for 1 day at 20° C.×65% RH, and the gram weight was measured with a fine balance, multiplied by 100 and converted to g/m$^2$, to determine the knitted fabric basis weight.

[Heat Insulation Rate (%)]

The heat-insulating property was measured by Method A (constant temperature method) of JIS L1096 (2010) 8.27, "Heat-insulating property". Specifically, a heat-insulating property tester (KES-F7 THERMO LABO type II by Kato Tech Corp.) was used for a heat-insulating property test by the dry contact method under the following conditions, and the heat insulation rate was calculated.

Heat-insulating property test conditions: A 15 cm×15 cm sample was cut out from the knitted fabric that had been humidified for 1 day at 20° C.×65% RH, and the test piece was set on a constant temperature heating element (hot plate) at 30° C. (environmental temperature+10° C.) under wind at 30 cm/sec, and allowed to stand for 15 minutes until the fabric reached a constant temperature. After stabilization, the electric power consumption (a) during 1 minute was measured. For comparison, the electric power consumption (b) was measured during the same time period but without setting a test piece, and the heat insulation rate (%) was calculated by the formula shown below. The heat-insulating property is the percent of reduced power consumption by decrease in the quantity of heat lost from the heating unit due to coverage of the heating unit by the test piece, compared to when the heating unit is not covered.

$$\text{Heat insulation rate (\%)}=(1-a/b)\times 100$$

[Elongation Percentage Under Constant Load (%)]

Test fabric strips each with a full length of 150 mm, with a test length of 100 mm having grip sections 25 mm above and below, and a test width of 25 mm, sampled at two points in the warp direction and weft direction of the knitted fabric, were inserted into the jig of a TENSILON universal material tester by A&D Co., Ltd. and stretched at a stretching rate of 300 mm/min, recording the length (mm) at a maximum load of 22.1 N (2.25 kgf). The measurement was conducted twice and the average was divided by the stretched length and multiplied by 100 to obtain a value as the elongation percentage.

[Press Shrinkage Rate (%)]

Two 250 mm×250 mm test pieces, sampled at two points in the warp direction and weft direction of the knitted fabric, were prepared to determine the press shrinkage rate (%) according to method H-2 of JIS L1096(2010)8.39, "Dimensional change". The press shrinkage rate was determined by the following formula. A shrinkage factor in the range of 0% to −2% in both the warp direction and weft direction was defined as acceptable.

$$\text{Press shrinkage rate (\%)}=\{(L_2-L_1\}\times 100$$

($L_1$=length before pressing, $L_2$=length after pressing)

Example 1

Polyester 85 decitex, 36-filament false twisted yarn was used in (threading holes) F1, F4, F7, F10 and F13 for the front fabric section and F2, F5, F8, F11 and F14 for the back fabric section, with the pattern shown in FIG. 1, with 78 decitex polyurethane elastic fibers as connecting yarns F3 and F15, in a 5 course/repeat without connecting F6, F9 and F12, and a greige was knitted using a 26 gauge double circular knitting machine by Precision Fukuhara Works Co., Ltd. A continuous hot-water relaxation/scouring machine was used for scouring at 80° C., followed by polyester disperse dyeing with a jet dyeing machine at a fabric speed of 300 m/min, and after soaping, the fabric was sufficiently stretched to remove the wrinkles and subjected to final setting at 140° C.×1 minute to obtain a knitted fabric. The obtained knitted fabric had a polyester fiber yarn weight mixing ratio of 91.7%, a polyurethane elastic fiber yarn weight mixing ratio of 8.3%, a loop density of 50 course/inch (2.54 cm), 43 wale/inch (2.54 cm), a basis weight of 180 g/m$^2$, a thickness of 1.06 mm, a heat insulation rate of 24.2%, a filling rate of 12.6%, an elongation percentage at a constant load of 87.0% in the warp direction and 217.1% in the weft direction, and a press shrinkage rate of −1.0% in the warp direction and −0.8% in the weft direction. The results are shown in Table 1 below.

Example 2

With the same pattern as Example 1, using 85 decitex, 36-filament polyester false twisted yarn for the front fabric, and 89 decitex, 96-filament combined filament yarn obtained by interlaced mixing of polyester 56 decitex, 72-filament false twisted yarn with cupra 33 decitex, 24-filament yarn for the back fabric, and with polyurethane 78 decitex elastic fiber as the connecting yarn, a 5 course/repeat pattern was used to knit a greige using a 26 gauge double circular knitting machine by Precision Fukuhara Works Co., Ltd. The greige was then dyed in the same manner as Example 1 to obtain a knitted fabric. The obtained knitted fabric had a polyester fiber yarn weight mixing ratio of 74.3%, a Cupro fiber mixing ratio of 17.0%, polyurethane elastic fiber yarn weight mixing ratio of 8.7%, a loop density of 47 course/inch (2.54 cm), 44 wale/inch (2.54 cm), a basis weight of 173 g/m$^2$, a thickness of 0.97 mm, a heat insulation rate of 25.1%, a filling rate of 13.0%, an elongation percentage at a constant load of 65.5% in the warp direction and 211.0% in the weft direction, and a press shrinkage rate of −1.2% in the warp direction and −0.8% in the weft direction. The results are shown in Table 1 below.

Example 3

With the same pattern as Example 1, using 60/1 polyester staple fibers for the front fabric and 85 decitex, 36-filament polyester false twisted yarn for the back fabric, and with polyurethane 78 decitex elastic fiber as the connecting yarn, a 5 course/repeat pattern was used to knit a greige using a 26 gauge double circular knitting machine by Precision Fukuhara Works Co., Ltd. The fabric was then dyed in the same manner as Example 1 to obtain a knitted fabric. The obtained knitted fabric had a polyester fiber thread weight mixing ratio of 91.8%, a polyurethane elastic fiber yarn weight mixing ratio of 8.3%, a loop density of 45 course/inch (2.54 cm), 44 wale/inch (2.54 cm), a basis weight of 171 g/m$^2$, a thickness of 0.95 mm, a heat insulation rate of 23.6%, a filling rate of 13.3%, an elongation percentage at a constant load of 50.6% in the warp direction and 210.0% in the weft direction, and a press shrinkage rate of −1.8% in the warp direction and −0.7% in the weft direction. The results are shown in Table 1 below.

Comparative Example 1

Figure 2:
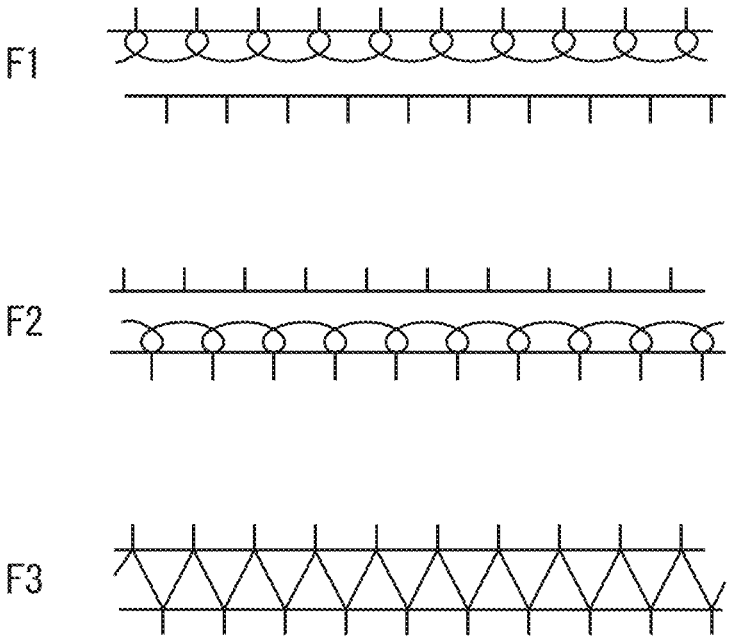
FIG. 2 is a knitting diagram for the elastic circular knitted fabric of Comparative Example 1.

Using 72 decitex, 72-filament false twisted yarn for the front fabric section F1 and 85 decitex, 35-filament polyester false twisted yarn for the back fabric section F2, in the pattern shown in FIG. 2, and with 56 decitex, 24-filament polyester false twisted yarn as the connecting yarn F3, a greige was knitted using a 32 gauge double circular knitting machine by Precision Fukuhara Works Co., Ltd. A continuous hot-water relaxing/scouring machine was used for scouring at 80° C., followed by pre-setting at 190° C.×1 minute and then polyester disperse dyeing with a jet dyeing machine at a fabric speed of 350 m/min, and after soaping, the fabric was sufficiently stretched to remove the wrinkles and subjected to final setting at 170° C.×1 minute to obtain a knitted fabric. The obtained knitted fabric had a polyester false twisted yarn weight mixing ratio of 100%, a loop density of 63 course/inch (2.54 cm), 47 wale/inch (2.54 cm), a basis weight of 210 g/m$^2$, a thickness of 0.82 mm, a heat insulation rate of 17.1%, a filling rate of 18.6%, an elongation percentage at a constant load of 49.9% in the warp direction and 113.7% in the weft direction, and a press shrinkage rate of −1.5% in the warp direction and −0.6% in the weft direction. The results are shown in Table 1 below.

Comparative Example 2

Figure 3:
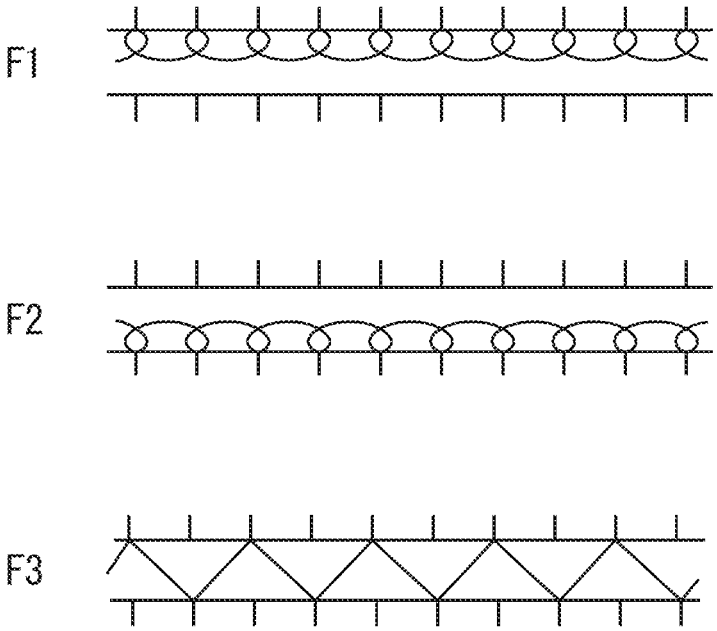
FIG. 3 is a knitting diagram for the elastic circular knitted fabric of Comparative Example 2.

Using 84 decitex, 36-filament polyester false twisted yarn and 22 decitex polyurethane elastic fibers for the front fabric section F1 and back fabric section F2, and with 155 decitex polyurethane elastic fibers as the connecting yarn F3, in the pattern shown in FIG. 3, a greige was knitted using a 26 gauge double circular knitting machine by Precision Fukuhara Works Co., Ltd. A continuous hot-water relaxing/scouring machine was used for scouring at 80° C., followed by pre-setting at 190° C.×1 minute and then polyester disperse dyeing with a jet dyeing machine at a fabric speed of 350 m/min, and after soaping, the fabric was sufficiently stretched to remove the wrinkles and subjected to final setting at 170° C.×1 minute to obtain a knitted fabric. The obtained knitted fabric had a 84 decitex, 36-filament polyester fiber yarn weight mixing ratio of 62%, a polyurethane elastic fiber yarn weight mixing ratio of 38%, a loop density of 60 course/inch (2.54 cm), 44 wale/inch (2.54 cm), a basis weight of 300 g/m$^2$, a thickness of 1.98 mm, a heat insulation rate of 33.8%, a filling rate of 12.3%, an elongation percentage at a constant load of 99.0% in the warp direction and 183.1% in the weft direction, and a press shrinkage rate of −2.3% in the warp direction and −1.2% in the weft direction. The results are shown in Table 1 below.

Comparative Example 3

With the same pattern as Example 1, using 72 decitex, 72-filament polyester false twisted yarn for the front fabric and back fabric sections, with 78 decitex polyurethane elastic fibers as the connecting yarn, a 5 course/repeat pattern was used to knit a greige using a 26 gauge double circular knitting machine by Precision Fukuhara Works Co., Ltd. A continuous hot-water relaxing/scouring machine was used for scouring at 80° C., followed by pre-setting at 190° C.×1 minute and then polyester disperse dyeing with a jet dyeing machine at a fabric speed of 350 m/min, and after soaping, the fabric was sufficiently stretched to remove the wrinkles and subjected to final setting at 170° C.×1 minute to obtain a knitted fabric. The obtained knitted fabric had a 72 decitex, 72-filament fiber yarn weight mixing ratio of 89.5%, a polyurethane elastic fiber yarn weight mixing ratio of 10.5%, a loop density of 42 course/inch (2.54 cm), 43 wale/inch (2.54 cm), a basis weight of 128 g/m$^2$, a thickness of 0.55 mm, a heat insulation rate of 15.7%, a filling rate of 17.4%, an elongation percentage at a constant load of 38.5% in the warp direction and 205.0% in the weft direction, and a press shrinkage rate of −2.7% in the warp direction and −1.3% in the weft direction. The results are shown in Table 1 below.

TABLE 1

| | Knitted fabric composition | | | | Formulation | |
|---|---|---|---|---|---|---|
| | Front yarn | Back yarn | Connecting yarn | Yarn weight mixing ratio % | Presetting | Fabric dyeing speed M/min |
| Example 1 | PET85T/36 | PET85T/36 | PU78T | PET91.7 PU8.3 | Without | 300 |
| Example 2 | PET85T/36 | PET*Cu89T/96 | PU78T | PET74.3 Cu17 PU8.7 | Without | 300 |
| Example 3 | PET60/1 | PET85T/36 | PU78T | PET91.8 PU8.3 | Without | 300 |
| Comp. Ex. 1 | PET72T/72 | PET85T/36 | PET56T/24 | PET100 | With | 350 |
| Comp. Ex. 2 | PET84T/36*PU22T | PET84T/36*PU22T | PU155T | PET62 PU38 | With | 350 |
| Comp. Ex. 3 | PET72T/72 | PET85T/36 | PU78T | PET89.5 PU10.5 | With | 350 |

TABLE 1-continued

| | Knitted fabric performance | | | | | | | | | |
|---|---|---|---|---|---|---|---|---|---|---|
| | Course | Wale | Thickness | Filling rate | Basis weight | Heat insulation rate | Elongation percentage at constant load (%) | | Shrinkage factor (%) | |
| | /inch | /inch | Mm | % | G/m$^2$ | % | Warp | Weft | Warp | Weft |
| Example 1 | 50 | 43 | 1.06 | 12.6 | 180 | 24.2 | 87.0 | 217.1 | −1.0 | −0.8 |
| Example 2 | 47 | 44 | 0.97 | 13.0 | 173 | 25.1 | 65.5 | 211.0 | −1.2 | −0.8 |
| Example 3 | 45 | 44 | 0.95 | 13.3 | 171 | 23.6 | 50.6 | 210.0 | −1.8 | −0.7 |
| Comp. Ex. 1 | 63 | 47 | 0.82 | 18.6 | 210 | 17.1 | 49.9 | 113.7 | −1.5 | −0.6 |
| Comp. Ex. 2 | 60 | 44 | 1.98 | 12.3 | 300 | 33.8 | 99.0 | 183.1 | −2.3 | −1.2 |
| Comp. Ex. 3 | 42 | 43 | 0.55 | 17.4 | 128 | 15.7 | 38.5 | 205.0 | −2.7 | −1.3 |

INDUSTRIAL APPLICABILITY

Since the three-dimensional elastic circular knitted fabric of the invention has a three-dimensional structure and is lightweight while exhibiting a heat-insulating property, and also exhibits stretchability and hot press shrinkage resistance, it can be satisfactorily used for outer wear, inner wear and sport wear, and is particularly suitable for indoor wear (room wear and lounge wear), sweat suits (sweatshirts and sweat pants), and hoodies, which require light weight and heat-insulating properties.

The invention claimed is:

1. A three-dimensional elastic circular knitted fabric in which two ground weaves on the front and back are bonded by connecting yarn with only a tuck structure, wherein the two ground weaves on the front and back consist entirely of non-elastic fibers, the connecting yarn consists entirely of elastic fibers, the elastic fibers are knitted in a mixture of 2 to 15 course/repeat, the loop density of the knitted fabric is 40 to 130 course/inch and 35 to 80 wale/inch, the filling rate is 5.0 to 25.0%, the heat insulation rate is 20.0% or greater, and the elongation percentage at a constant load of 22.1 N is 50 to 200% in the warp direction and 150 to 300% in the weft direction.

2. The three-dimensional elastic circular knitted fabric according to claim 1, wherein the non-elastic fiber is polyester or nylon synthetic fiber single yarn or composite yarn comprising either or both polyester or nylon yarn.

3. The three-dimensional elastic circular knitted fabric according to claim 1, wherein the yarn weight mixing ratio of elastic fibers with respect to the entire knitted fabric is 5 to 15%.

4. The three-dimensional elastic circular knitted fabric according to claim 1, wherein the press shrinkage rate in the warp direction and weft direction is in the range of 0 to −2% according to JIS L 1096 H-2.

5. Outer wear comprising a three-dimensional elastic circular knitted fabric according to claim 1.

6. Inner wear comprising a three-dimensional elastic circular knitted fabric according to claim 1.

7. Sport wear comprising a three-dimensional elastic circular knitted fabric according to claim 1.

* * * * *